US008141372B2

(12) United States Patent
Guffler et al.

(10) Patent No.: US 8,141,372 B2
(45) Date of Patent: Mar. 27, 2012

(54) METHOD FOR OPERATING A REFRIGERATING DEVICE COMPRISING EVAPORATORS WHICH ARE CONNECTED IN PARALLEL AND REFRIGERATING DEVICE THEREFOR

(75) Inventors: Thomas Guffler, Wittislingen (DE); Wolfgang Nuiding, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 805 days.

(21) Appl. No.: 12/225,950

(22) PCT Filed: Mar. 12, 2007

(86) PCT No.: PCT/EP2007/052295

§ 371 (c)(1),
(2), (4) Date: Oct. 3, 2008

(87) PCT Pub. No.: WO2007/115879

PCT Pub. Date: Oct. 18, 2007

(65) Prior Publication Data

US 2009/0173086 A1 Jul. 9, 2009

(30) Foreign Application Priority Data

Apr. 5, 2006 (DE) ..... 10 2006 015 989

(51) Int. Cl.
*F25B 5/00* (2006.01)

(52) U.S. Cl. ..... 62/117; 62/441

(58) Field of Classification Search ..... 62/117, 62/155, 156, 157, 441, 440, 442
See application file for complete search history.

(56) References Cited

U.S. PATENT DOCUMENTS

| | | | | |
|---|---|---|---|---|
| 4,389,854 | A * | 6/1983 | Ogita et al. | 62/157 |
| 4,537,041 | A * | 8/1985 | Denpou et al. | 62/199 |
| 4,741,171 | A | 5/1988 | Toshiyuki | |
| 6,058,723 | A * | 5/2000 | Kusunoki et al. | 62/156 |
| 6,397,608 | B1 | 6/2002 | Sakuma et al. | |
| 7,726,141 | B2 * | 6/2010 | Sim et al. | 62/179 |
| 2002/0014082 | A1 * | 2/2002 | Hiraoka et al. | 62/127 |
| 2003/0000241 | A1 | 1/2003 | Holz et al. | |
| 2005/0217284 | A1 * | 10/2005 | An et al. | 62/135 |
| 2007/0137226 | A1 * | 6/2007 | Kim et al. | 62/180 |

FOREIGN PATENT DOCUMENTS

| | | |
|---|---|---|
| DE | 3431452 A1 | 2/1986 |
| EP | 1 030 133 | 8/2000 |
| EP | 1 182 410 | 2/2002 |
| EP | 1 424 530 | 6/2004 |
| GB | 2 390 419 | 1/2004 |
| JP | 2002-286347 | 10/2002 |

OTHER PUBLICATIONS

International Search Report PCT/EP2007/052295.

* cited by examiner

*Primary Examiner* — Mohammad Ali
(74) *Attorney, Agent, or Firm* — James E. Howard; Andre Pallapies

(57) ABSTRACT

A method for operating a refrigerator includes supplying an evaporator of a second compartment with coolant and flushing the coolant out of the evaporator of the second compartment so that it can be used for an evaporator of a first compartment, closing a coolant circuit to the evaporator of the second compartment, and supplying only the evaporator of the first compartment with coolant.

17 Claims, 4 Drawing Sheets

METHOD FOR OPERATING A REFRIGERATING DEVICE COMPRISING EVAPORATORS WHICH ARE CONNECTED IN PARALLEL AND REFRIGERATING DEVICE THEREFOR

BACKGROUND OF THE INVENTION

The present invention relates to a method for operating a refrigeration device with a refrigerating circuit with two evaporators arranged in parallel to each other which cool thermally-separated refrigerator compartments which can have different compartment temperatures, as well as a compressor, with which the two evaporators are able to have coolant applied to them separately. The present invention also relates to such a refrigeration device for executing the inventive method of operation.

A fridge-freezer combination is known from DE 199 57 719 A1 in which the refrigerator compartment and the freezer compartment are cooled by evaporators arranged in a parallel circuit to each other and supplied by one and the same compressor. A magnetic valve allows the refrigerator compartment evaporator and the freezer compartment evaporator to have coolant applied separately to them, which makes separate temperature regulation of the two compartments possible.

A problem associated with having parallel circuits for the refrigerator compartment evaporator and for the freezer compartment evaporator is that during the idle time of the compressor, as a result of the different temperatures of the two evaporators, coolant evaporated in the refrigerator compartment has a tendency to flow into the freezer compartment and to condense there. If subsequently as a result of a demand for cooling of the refrigerator compartment the compressor is switched on and coolant is pumped around through the refrigerator compartment evaporator, the amount of coolant available is small and the cooling power able to be obtained is low, so that long compressor operating times or in extreme cases even malfunctions can occur.

To alleviate this problem, it is proposed in DE 199 57 719 A1 that a section of the freezer compartment evaporator in which coolant collects during the idling period of the compressor be designed so that this section, in respect of a coolant filling volume, is designed to be filled at least approximately with its entire volume of liquid coolant in the idle phase of the compressor, and to place it so that, if the compressor is switched on as a result of a cooling request from the refrigerator compartment, the coolant flowing through the coolant circuit of the controlled refrigerator compartment evaporator flows with the liquid coolant from the stated section of the freezer compartment evaporator, which causes the latter to cross into the coolant circuit of the controlled refrigerator compartment evaporator. The disadvantage however is that the carry-over effect is weaker, the smaller the mass flow rate through the refrigerator compartment evaporator is. I.e. the more liquid coolant has collected in the freezer compartment evaporator, the smaller is the rate at which it is extracted from the freezer compartment evaporator and can be fed back to the flow of coolant through the refrigerator compartment evaporator. This likewise results in increased compressor run times and thus in an increased energy use of the refrigeration device. A complete solution to the problem has thus not yet been achieved.

BRIEF SUMMARY OF THE INVENTION

The underlying object of the present invention was to specify a method of operation for a refrigeration device described at the outset with evaporators arranged in parallel to each other and a refrigeration device for executing the method of operation which makes it possible to operate the refrigerator device in a simple and cost-effective manner.

Accordingly a method for operating a refrigeration device is provided having a coolant circuit which comprises two evaporators arranged in parallel to each other with different cooling power which cool refrigerating compartments separated thermally from one another, as well as comprising a compressor with which coolant is able to be applied to the two evaporators separately from one another. Inventively when cooling is required in a first of the compartments, in a preparation step, coolant is first applied to the evaporator of higher cooling power, subsequently the coolant circuit to this evaporator is closed off, i.e. supply of coolant to this evaporator is suppressed, and coolant is only applied to the evaporator with lower cooling power. The application of coolant to the higher-power evaporator provided in the preparation step means that liquid coolant which could have collected during the idle phase of the compressor in the evaporator of higher cooling power is pushed out of the latter and thus is available again to the coolant circuit of the lower cooling power evaporator. This allows a displacement of coolant to the colder of the two compartments, which occurs during the idle phase as described above, to be rectified simply, quickly and in an energy-saving manner. The second refrigerating compartment, which is activated in the preparation phase, is thus as a rule the compartment which has a lower temperature than the first refrigerating compartment.

Preferably the coolant circuit to the lower-cooling-power evaporator is closed off in the first compartment during the preparation step. This means that only the higher-cooling-power evaporator in the second compartment is activated and has coolant applied to it. The advantage of this is that coolant only has to be demanded by one evaporator, enabling energy to be saved by the compressor. This means that preferably only that compartment, namely the colder of the two compartments, is activated in which during the idle phase of the compressor a certain amount of liquid coolant has collected.

There is however also the option of activating both evaporators and applying coolant to them in the preparation step. The advantage of this is that the two compartments can be handled in the same way, which simplifies the control logic. If the compartment signaling that cooling is required is the colder of the two compartments, a brief circulation of coolant through the warmer compartment before the colder one is supplied has no disadvantages other than briefly delaying the onset of the cooling effect. An expedient option is to apply coolant to the two refrigerating compartments, even in a refrigeration device in which its construction does not already dictate which of the compartments must have the lower operating temperature, since then, when the compressor starts up as a result of the demand for cooling in one of the compartments, it does not have to be first established which is the colder compartment and thus the one which is to be given priority for activation.

Preferably the preparation step is executed over a specific period of time after the compressor starts up. The period of time is selected so that the evaporator of the first refrigerating compartment can be provided after the preparation step with a sufficient or almost the entire amount of coolant.

Alternatively work done by the compressor can be measured in order to end the preparation step if the work done reaches a predetermined level. This reduces the duration of the preparation step if the amount of liquid coolant that has collected in the colder evaporator is large and the coolant pressure against which the compressor operates is correspondingly small, and lessens when the accumulated amount of the liquid coolant is small.

A coolant collector can be connected upstream from the compressor to accommodate the liquid coolant flushed out of the evaporator of the second refrigerating compartment and if necessary out of the evaporator of the first refrigerating compartment during the preparation step.

The present invention further comprises a refrigeration device for carrying out the method of operation described above. Accordingly a refrigeration device with a coolant circuit is provided, comprising two evaporators arranged in parallel to one another which cool thermally-separated refrigerating compartments which can have different compartment temperatures, and comprises a compressor with which coolant is able to be applied the two evaporators separately from one another. Furthermore the refrigeration device comprises a control device for controlling the supply of coolant to the evaporators. Inventively the control device is configured, in the event of a demand for cooling from a first of the compartments, to cause coolant to be applied to the evaporator of the second compartment in a preparatory step, subsequently the coolant circuit to the evaporator of the second compartment to be closed off and coolant only still to be applied to the evaporator of the first compartment.

Preferably the control device features a valve with a first operating position in which coolant is able to be applied to the evaporator of the first compartment and a second operating position in which coolant is able to be applied to the evaporator of the second compartment. The valve can be a 3/2-port valve for example. If the coolant circuit only includes only one such valve, the refrigeration device can be operated such that coolant is exclusively applied to the second, colder evaporator in the preparatory step.

Preferably the valve has a third operating position as well as the first and second operating position, in which coolant is able to be applied to both evaporators. This provides the option, with a single valve connected upstream in the coolant circuit from the evaporator, for example a 4/3-port valve, of making it possible to operate the refrigeration device in a mode in which coolant is applied to both the evaporators in a preparatory step, in order to flush out any liquid coolant located in the evaporators.

As well as the above-mentioned equipping of the refrigeration device with only one single valve for controlling the supply of coolant to the evaporators, there is also the option of providing a refrigeration device which has two valves, each with two operating positions, to control the supply of coolant to the evaporators, with coolant able to be applied in a first operating position to the evaporator of the first compartment, coolant able to be applied in a second operating position of the first valve and a first operating position of a second valve downstream from the first valve to the evaporator of the second compartment and in which coolant is able to be applied to both compartments in a second operating position of the first valve and a second operating position of the second valve. The two valves can for example involve 3/2-port valves.

The inventive refrigeration device preferably features a holdback facility, such as non-return valve, in order to prevent an undesired flow of coolant in a connecting line between the two evaporators. Such a connecting line is for example present if an output of a valve upstream from the evaporators is connected to both evaporators In a further alternative embodiment of the inventive refrigeration device a valve is connected upstream of each evaporator for controlling the supply of coolant, with said valve able to be switched between an open and a closed position. This provides the option of operating the refrigeration device such that, in the preparation step, when the compressor starts up, the two valves are opened in order to flush out liquid coolant from both evaporators and subsequently, for example after a specific period of time, to close the valve of that evaporator which has not made any cooling demand.

The valves for controlling the supply of coolant mentioned above are preferably electrically-activatable valves, for example magnetic valves.

The inventive refrigeration device preferably involves a refrigerator, a freezer or a fridge-freezer.

BRIEF DESCRIPTION OF THE DRAWINGS

Further embodiments and advantages of the present invention are explained below with reference to a number of embodiments of the present invention. The figures show.

DETAILED DESCRIPTION OF THE PRESENT INVENTION

Figure 1:
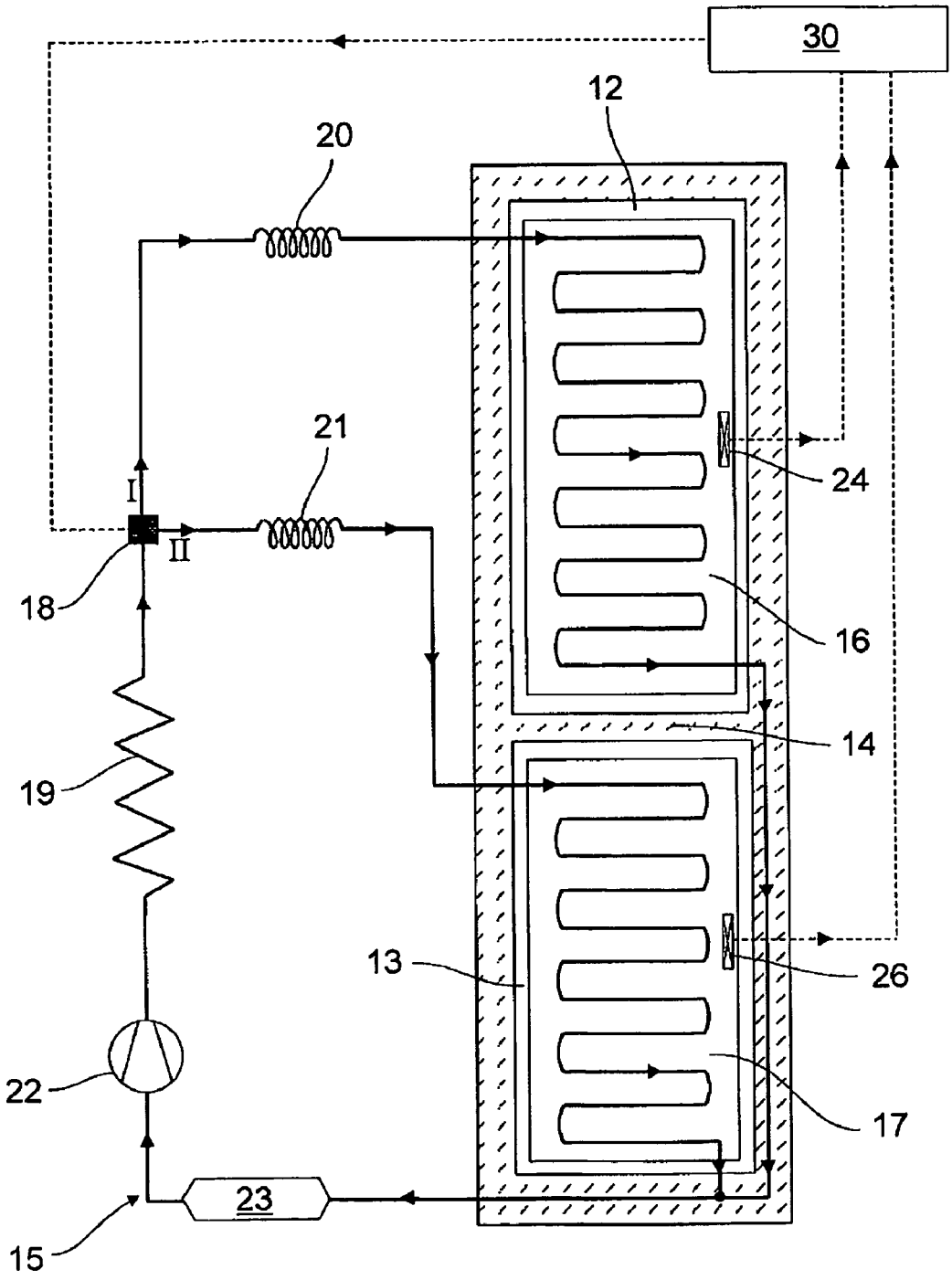
FIG. 1 a schematic diagram of a refrigeration device in accordance with a first embodiment, with two thermally-separated refrigerating compartments 12, 13, which have different compartment temperatures and which are cooled by evaporators 16, 17 arranged in a coolant circuit 15 in parallel with a common compressor 22, with the evaporators 16, 17 having an upstream 3/2-port magnetic valve 18 in the coolant circuit 15.

FIG. 1 shows a highly schematicized presentation of a domestic refrigeration device within the heat-insulating housing 11 of which are arranged two refrigerating compartments 12 and 13. These are separated thermally from one another by a dividing panel 14 embodied as a thermal insulator. During operation of the refrigeration device the two refrigerating compartments 12 and 13 are at different temperatures. This can involve fridge and freezer compartments.

The refrigerating compartments 12, 13 are cooled using a coolant circuit 15 with two evaporators 16, 17 arranged in parallel, with the first, upper compartment 12 being assigned evaporator 16 and the second, lower compartment 13 evaporator 17. The evaporators 16 and 17 shown as Goldwall evaporators, which are accommodated in each case on an inner wall of the compartments 12 or 13 and which feature a plate on which a serpentine coolant line is embodied. Unlike in the embodiment shown, the evaporators 16, 17 can however also be embodied tubular evaporators arranged horizontally in the compartment 12 or 13, running through the compartment, if the refrigerating compartments 12 or 13 involved are freezer compartments 12 or 13 for example. An evaporator of a no-frost design which is accommodated in a chamber separated from one of the compartments 12 or 13 and communicating with it by forced ventilation also comes into consideration.

The coolant circuit 15 has a single compressor 22. Connected to the compressor 22 on the pressure side is an evaporator 19 which is connected on its output side to an electrically-activatable 3/2-port magnetic valve 18. An output of the magnetic valve 18 is connected via a choke tube 20 to the evaporator 16 of the first refrigerating compartment 12 and a further output of the magnetic valve 18 via a further choke tube 21 to the evaporator 17 of the second refrigerating compartment 13. The choke tubes 20 and 21 are embodied in the shape of a spiral and are used to reduce the pressure of the liquid coolant flowing from the compressor 19 to the evaporators 16, 17.

The evaporators 16 and 17 are linked on the output side with the suction side of the compressor 22, with the compressor 22 having a coolant collector 23 connected upstream from it. This receives liquid coolant flowing out of the two evaporators 16, 17 and prevents liquid coolant being able to get into the compressor 17.

The 3/2-port magnetic valve 18 is used for control of the coolant forcibly circulated by the compressor 22 to the evaporators 16 and 17. In one operating position I of the magnetic valve 18 liquid coolant is fed via the choke 20 exclusively to the evaporator 16 of the first refrigerating compartment 12, i.e. the circuit of coolant to the evaporator 17 is a closed circuit. As well as the operating position I, the magnetic valve 18 has an operating position II, in which the forcibly circulated, vaporized coolant is fed via the choke 21 exclusively to the evaporator 17 of the second refrigerating compartment 13, i.e. the coolant circuit to the evaporator 16 is closed.

In each of the refrigerating compartments 12, 13 there is a temperature sensor 24 or 26, which measures the respective compartment temperature or evaporator temperature and forwards this to an evaluation unit 30 which is part of a control device of the refrigeration device, which controls the supply of coolant to the evaporators 16, 17. The evaluation unit 30 activates the magnetic valve 18 which is likewise part of the control device, depending on the temperature determined by the temperature sensor 24 or 26, and specifies one of the operating positions to it.

The domestic refrigeration device shown in FIG. 1 is operated, each time that the compressor 22 starts up as a result of a cooling demand in one of the refrigerating compartments 12, 13, by the evaporator of the coldest compartment initially being activated via the magnetic valve 18 and having coolant applied to it. This flushes out the coolant collected in the colder evaporator, which allows it to be made available again to the coolant circuit of the warmer refrigerating compartment.

With a fridge-freezer combination, which will now be used as a starting point below, the temperature ranges of the two compartments are fixed, so that a fixed assignment exists between one of the operating positions I or II of the magnetic valve 18 and the colder of the two evaporators 16, 17. If for example the first compartment 12 operates in a temperature range of around +4° C. to +8° C. and the second compartment 13 in a temperature range of around −18° C. to −22° C., the evaporator 17 of the colder compartment 13 is activated via the operating position II of the magnetic valve 18.

If a demand for cold from the warmer refrigerating compartment 12 is determined via the temperature sensor 24, when the compressor 22 starts up, the magnetic valve 18 is initially moved into its operating position II in a preparation step. This pushes coolant via the choke 21 into the evaporator 17 of the colder refrigerating compartment 13. This coolant can be gaseous when the compressor starts to operate, or if it is liquid, it evaporates quickly on entry into the evaporator 17, so that by using a smaller mass of coolant a greater volume flow is achieved in the evaporator 17. This volume flow pushes the liquid coolant accumulated during the idle phase of the compressor 22 out of the evaporator 17, with the mass of coolant applied to push out the coolant, since it is gaseous, being significantly smaller than the pushed out liquid coolant. The pushed out coolant is initially received by the coolant collector 23, located on the suction side of the compressor 22.

To supply liquid coolant to the evaporator 16 of the warmer refrigerating compartment 12 the magnetic valve 18 is switched over to its operating position I. A switchover can for example occur after a defined period of time after the compressor starts up in which the coolant has been flushed out of the evaporator 17. Under the low pressure prevailing on the suction side of the compressor 22 the coolant gradually evaporates in the coolant collector 23 and is then available to the coolant circuit of the warmer refrigerating compartment 12 again.

In order to determine the switchover point, the work done by the compressor 22 since it was switched on can also be monitored and a switchover made if this work has exceeded a predetermined value. The smaller the volume of coolant to be driven out of the evaporator 17 actually is, the higher is the pressure against which the compressor 22 operates. Thus the switchover also occurs more quickly if the volume of coolant to be driven out is small. Alternatively the power of the compressor can also be monitored and switched over if an increase in the compressor power allows it to be concluded that the liquid coolant received into the coolant collector 23 is beginning to evaporate.

If the refrigerating compartments 12 and 13 are variable as regards their compartment temperatures, so that, depending on the device setting or operating state, the first refrigerating compartment 12 or the second refrigerating compartment 13 can have the lower temperature range, if there is a cooling demand from one of the compartments 12, 13, it is determined with the aid of the temperature sensors 24, 26 which of the two is currently the colder compartment and thus the compartment to be activated in the preparatory step.

Figure 2:
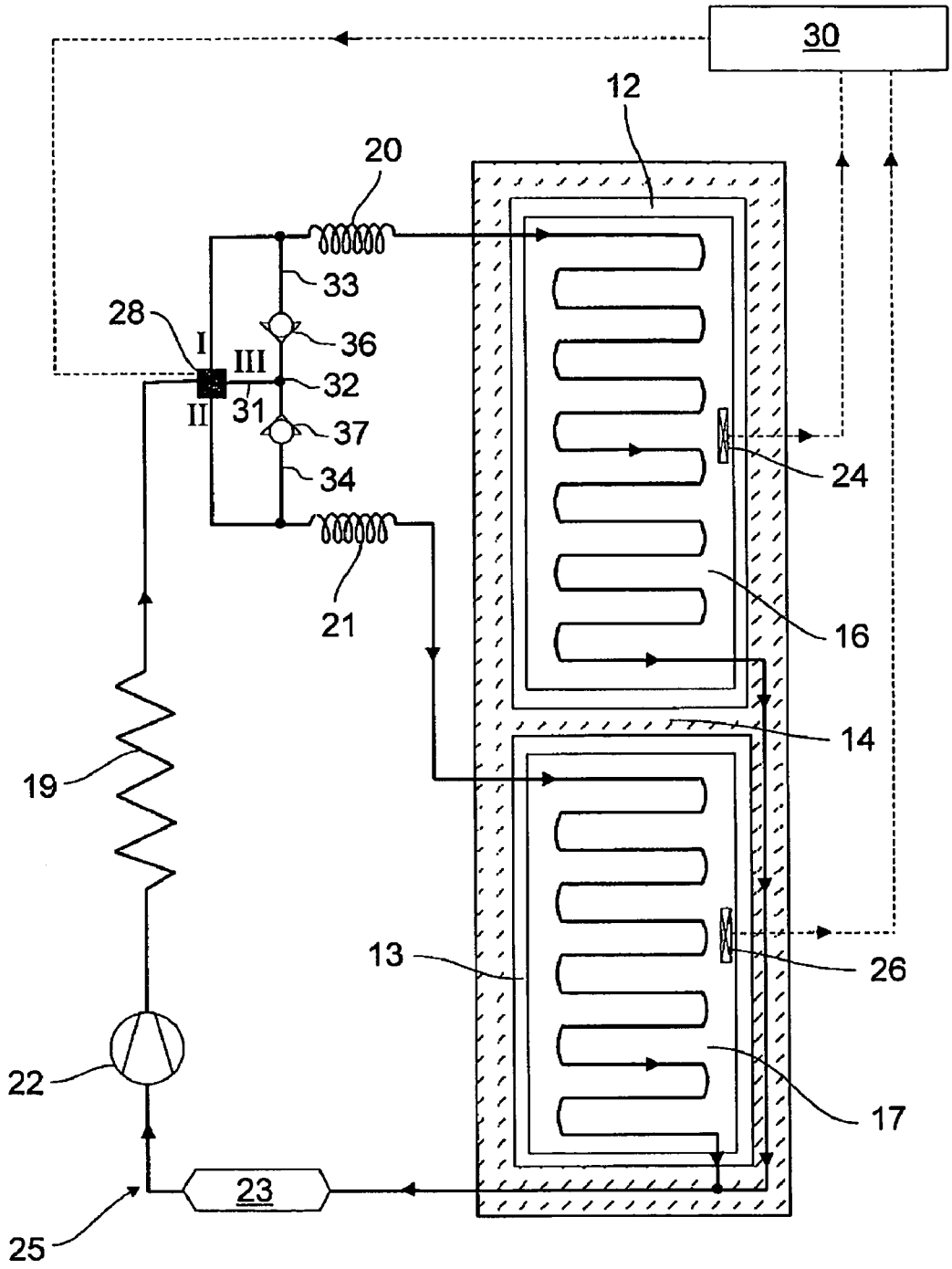
FIG. 2 a schematic diagram of a second embodiment of a refrigerating device, in which a 4/3-port magnetic valve 28 is connected upstream from the two evaporators 16, 17.

FIG. 2 likewise shows a schematic diagram of a second embodiment of a refrigeration device, which matches the refrigeration device depicted in FIG. 1 by having two thermally-separated refrigerating compartments 12 and 13 with different compartment temperatures, which are cooled by evaporators 16, 17 arranged in parallel to each other in a coolant circuit 25. For control of the coolant inflow to the evaporators 16, 17 the coolant circuit 25 features a 4/3-port magnetic valve 28. A first output of the magnetic valve 28 is connected via a choke tube 20 directly to the evaporator 17 of the upper refrigerating compartment 12. A second output of the magnetic valve 28 is connected via a choke tube 21 directly to the evaporator 17 of the lower refrigerating compartment 13. A third output of the magnetic valve 28 is connected via a connecting line 31, a branching point 32 and a branch line 33, which branches off from the choke tube 20, both to the evaporator 16 of the upper refrigerating compartment 12 as also via the connecting line 31, the branching point 32 and branch line 34, which branches off to the choke tube 21, to the evaporator 17 of the lower refrigerating compartment 13.

In a first operating position I of the magnetic valve 28, which releases the first output, exclusively the evaporator 16 of the upper refrigerating compartment 12 is located in the coolant circuit with the compressor 22. In a second operating position II of the magnetic valve 28, which releases the second output, exclusively the evaporator 17 of the lower refrigerating compartment is located in the coolant circuit with the compressor 22. In a third operating position III, which releases the third output of the magnetic valve 28, both evaporators 16, 17 in the coolant circuit are coupled in with the compressor 22, so that coolant is able to be applied to both evaporators 17 simultaneously. To prevent the coolant flowing over in operating positions I and II via the branches 33, 34 into the respective other evaporator which is not to be supplied, there is a non-return valve 36 or 37 in each branch line.

If the temperature sensors 24, 26 of the evaluation unit 30 establish that cooling is required in one of the refrigerating compartments 12, 13, when the compressor 22 starts up, the magnetic valve 28 is initially put in a preparation phase into the operating position III in which the two evaporators 16, 17 lie in the coolant circuit with the compressor 22 and thus have coolant applied to them. This flushes out the liquid coolant which has collected in the two evaporators 16, 17 and it is initially received by the coolant collector 23. To match the embodiment described with reference to FIG. 1 the magnetic valve 28 is now placed in its operating position I or II at the refrigerating compartment 12 or 13, indicating that cooling is required, with either exclusively the evaporator 16 of the upper refrigerating compartment 12 or exclusively the evaporator 17 of the lower refrigerating compartment 13 being brought into the coolant circuit with the compressor 22 and having coolant applied to it. The effect of the preparation step is that the evaporator 16 or 17 requesting cooling has available to it a sufficient amount or almost the entire coolant amount in the coolant circuit 25.

Figure 3:
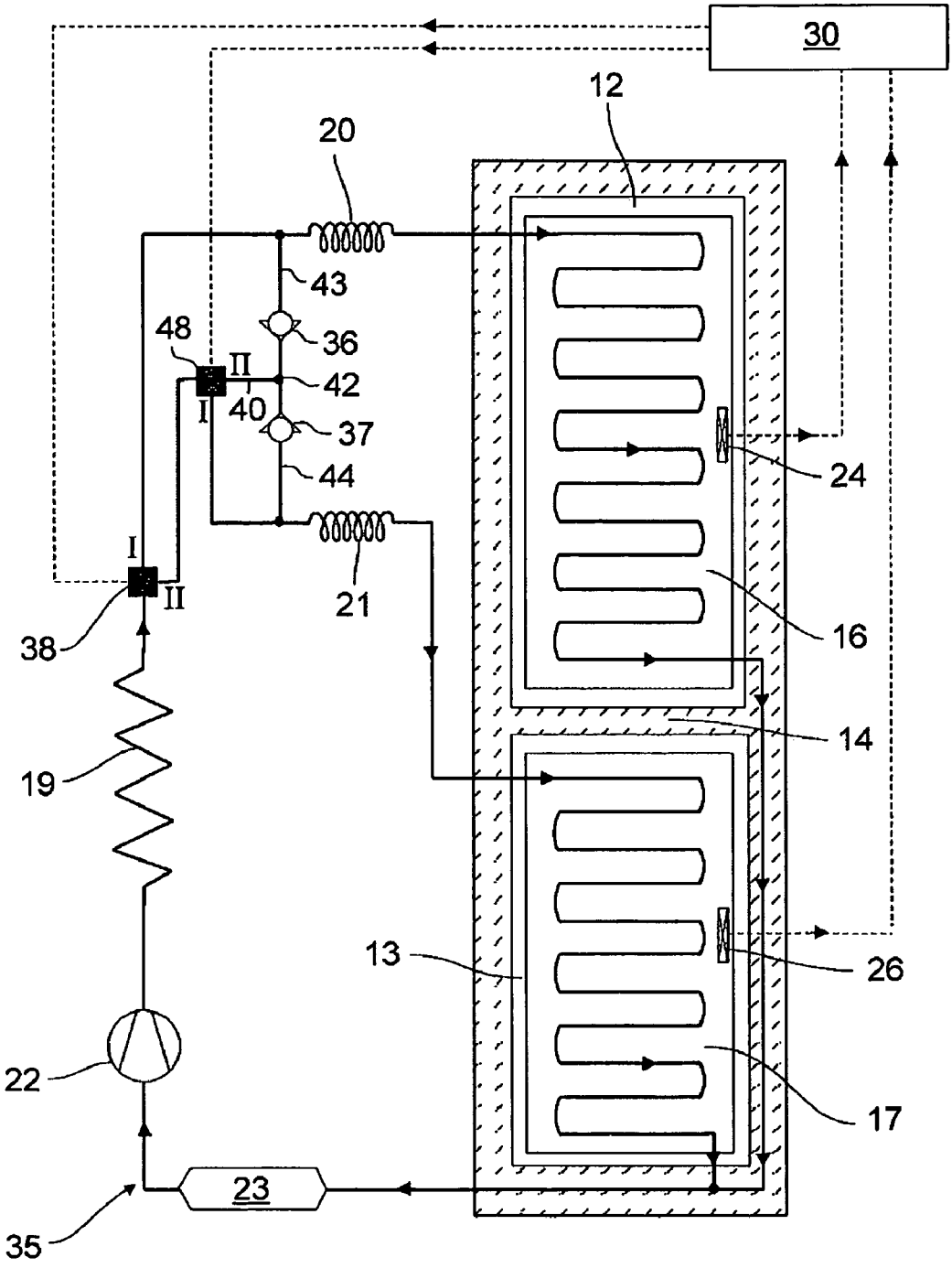
FIG. 3 a schematic diagram of a third embodiment of a refrigeration device, in which two 3/2-port magnetic valves 38, 48, are arranged one after the other upstream from the evaporators 16, 17.

FIG. 3 shows a third embodiment, in which, as depicted in that of FIG. 2, a simultaneous activation of the two evaporators 16, 17 is possible. In this embodiment two 3/2-port, magnetic valves 38, 48 are connected upstream from the two evaporators in the coolant circuit 35. A first 3/2-port magnetic valve 38 is connected on the input side to the evaporator 19. A first output of the magnetic valve 38 is connected via the choke tube 20 directly to the evaporator 16 of the upper refrigerating compartment 12, and a second output of the magnetic valve 38 is connected to the input of the second 3/2-port, magnetic valve 48. A first output of the second magnetic valve 48 is connected via the choke tube 21 directly to the evaporator 17 of the lower refrigerating compartment 13. A second output of the second magnetic valve 48 is connected via a connecting line 40 and a branch point 42 on the one hand via a branch line 43 via the choke tube 20 to the evaporator 16 of the upper refrigerating compartment 12 and on the other hand via a branch line 44 via the choke tube 21 to the evaporator 17 of the lower refrigerating compartment 13. The branch lines 43, 44 each contain a non-return valve 36 or 37.

In a first operating position I of the first magnetic valve 38, which releases the first output, exclusively the evaporator 16 of the colder compartment 12 is in the coolant circuit with the compressor 22. This setting can be selected if only compartment 12 indicates the need for cooling.

In an operating position II of the first magnetic valve 38 and in an operating position I of the second magnetic valve 48, exclusively the evaporator 17 of the lower refrigerating compartment is in the coolant circuit with the compressor 22. In operating position II of the first magnetic valve 38 and an operating position II of the second magnetic valve both compressors 16, 17 are in the coolant circuit with the compressor.

If the warmer compartment 13 indicates that it requires cooling, the magnetic valves 38 and 48, in a preparation phase on startup of the compressor 22, are each initially put into their second operating position II in order to flush liquid coolant out of the evaporators 16, 17. Subsequently the valve 48 is switched over to its operating position I, in order to only apply coolant to the evaporator 17.

Figure 4:
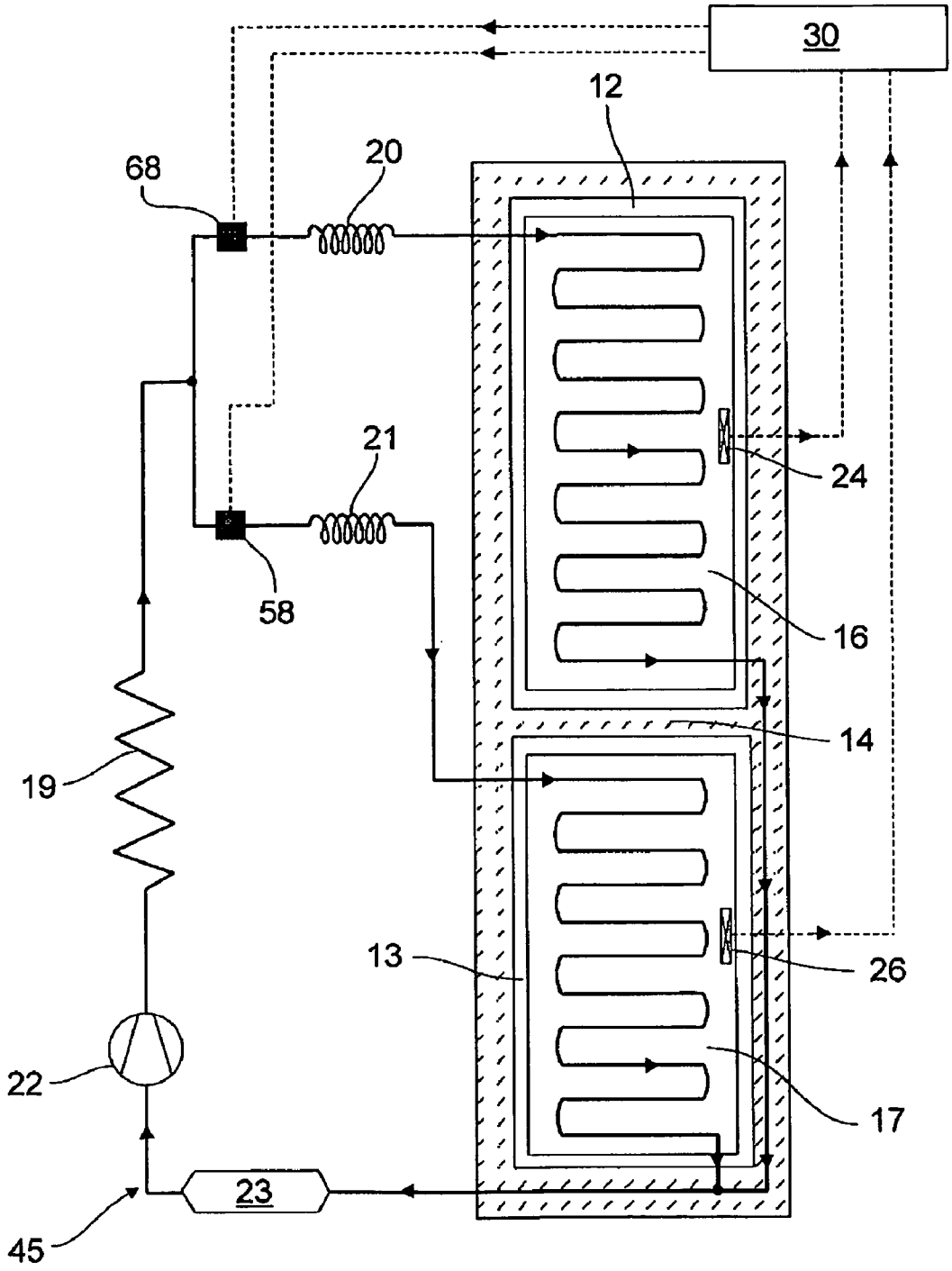
FIG. 4 a schematic diagram of a fourth embodiment of a refrigeration device in which a 2/1-port magnetic valve 58, 68 is connected upstream from each evaporator 16 or 17.

In the fourth embodiment shown in FIG. 4, a 2/1, port magnetic valve 58 or 68 is connected upstream from each of the evaporators 16, 17 located in each case in the direct feed line to the respective evaporator 16, 17. The magnetic valves 58, 68 are thus, just like the evaporator 16, 17, arranged in the coolant circuit 45 in parallel to each other. The magnetic valves 58 and 68 each have an open position and a closed position. The magnetic valves 58 and 68 are controlled via the evaluation unit 30.

If there is a demand for cooling in one of the refrigerating compartments 12 or 13, when the compressor 22 starts up, the two magnetic valves 58 and 68 are initially put into their open position, with coolant being applied to both evaporators 16, 17, which flushes out the liquid coolant to be found in the evaporators 16, 17. If a sufficient amount is flushed out, the refrigerating compartments 12 or 13 not requesting cooling are uncoupled from the coolant circuit 45 by the respective upstream magnetic valve 58 or 68 respectively being put into its closed position.

The invention claimed is:

1. A method for operating a refrigeration device with a coolant circuit having two evaporators of different cooling power arranged in parallel to one another which cool thermally-separated first and second refrigerating compartments and a compressor which is able to supply coolant separately to the two evaporators, the method comprising:

initially supplying coolant in a preparation step at least to the evaporator with the higher cooling power when there is a predetermined demand for cooling in the first refrigerating compartment to push coolant that collected during an idle phase out of the evaporator with the higher cooling power such that the coolant is available to the evaporator with the lower cooling power;

subsequently closing off the coolant circuit to the evaporator of the first refrigerating compartment; and supplying coolant only to the evaporator of lower cooling power.

2. The method as claimed in claim 1, wherein coolant is supplied to the two evaporators in the preparation step.

3. The method as claimed in claim 1, wherein the coolant circuit to the evaporator of the first refrigerating compartment is closed off in the preparation step.

4. The method as claimed in claim 1, wherein the step of initially supplying coolant in the preparation step includes carrying out the preparation step over a predetermined period of time after the compressor starts up.

5. The method as claimed in claim 1, wherein the step of initially supplying coolant in the preparation step includes carrying out the preparation step until the power of the compressor exceeds a limit value.

6. The method as claimed in claim 1, wherein the second refrigerating compartment operates at a lower temperature than the first refrigerating compartment.

7. A refrigeration device comprising:

a coolant circuit having two evaporators of different cooling power arranged in parallel to one another, which cool first and second refrigerating compartments thermally separated from each other;

a compressor which is able to supply coolant separately to both evaporators;

a control device for controlling the supply of coolant to the evaporators; and the control device being configured so that when there is a predetermined demand for cooling in the first refrigerating compartment, coolant is supplied to at least the evaporator of higher cooling power as a preparation step to push coolant that collected during an idle phase out of the evaporator with the higher cooling power such that the coolant is available to the evaporator with the lower cooling power, and subsequently the coolant circuit to the evaporator of higher cooling power is closed off and only the evaporator of lower cooling power has coolant supplied to it.

8. The refrigeration device as claimed in claim 7, wherein the control device includes a valve with a first operating position in which coolant is able to be applied to the evaporator of the first refrigerating compartment, and a second operating position in which coolant is able to be supplied to the evaporator of the second refrigerating compartment.

9. The refrigeration device as claimed in claim 8, wherein the valve includes a third operating position in which coolant is able to be supplied to both evaporators.

10. The refrigeration device as claimed in claim 9, wherein the valve involved is a 4/3-port valve.

11. The refrigeration device as claimed in claim 7, wherein the control device includes first and second valves each with two operating positions, such that in a first operating position of the first valve, coolant is able to be supplied to the evaporator of the first refrigerating compartment, in a second operating position of the first valve and a first operating position of the second valve arranged after the first valve, coolant is able to be supplied to the evaporator of the second refrigerating compartment, and in the second operating position of the first valve and a second operating position of the second valve, coolant is able to be supplied to the evaporators of both refrigerating compartments.

12. The refrigeration device as claimed in claim 11, wherein the valves involved are 3/2-port valves.

13. The refrigeration device as claimed in claim 7 further including a connecting line between the two evaporators and a holdback facility for preventing a flow of coolant in the connecting line.

14. The refrigeration device as claimed in claim 13, wherein the holdback facility is a non-return valve.

15. The refrigeration device as claimed in claim 7, wherein a valve which is able to be switched between an open and a closed position is connected upstream from each evaporator in the coolant circuit.

16. The refrigeration device as claimed in claim 8, wherein the valves are electrically activatable valves.

17. The refrigeration device as claimed in claim 16, wherein the electrically activatable valves are magnetic valves.

* * * * *